US005894923A

United States Patent [19]

Hamstra et al.

[11] Patent Number: 5,894,923

[45] Date of Patent: Apr. 20, 1999

[54] FOLDING LABEL PACKAGE

[75] Inventors: Randall W. Hamstra, Grandville; Jan M. Wiersma, Zeeland, both of Mich.

[73] Assignee: Batts, Inc., Zeeland, Mich.

[21] Appl. No.: 08/934,215

[22] Filed: Sep. 19, 1997

[51] Int. Cl.[6] ..... B65D 69/00

[52] U.S. Cl. ..... 206/232; 206/526; 206/820

[58] Field of Search ..... 206/39.7, 232, 206/447, 461, 494, 526, 806, 820, 425

[56] References Cited

U.S. PATENT DOCUMENTS

| | | | |
|---|---|---|---|
| 3,553,851 | 1/1971 | Paige | 206/232 |
| 3,692,176 | 9/1972 | Templeton et al. | 206/820 |
| 4,060,168 | 11/1977 | Romagnoli | 206/820 |
| 4,534,582 | 8/1985 | Howard | 283/81 |
| 4,726,972 | 2/1988 | Instance | 428/40 |
| 4,984,683 | 1/1991 | Eller | 206/39.7 |
| 5,022,526 | 6/1991 | Crum | 206/459 |

*Primary Examiner*—David T. Fidei
*Attorney, Agent, or Firm*—Baker & McKenzie

[57] ABSTRACT

A label package consisting of only label stock, in which labels are formed, releasably secured to liner stock, said two ply structure being formed into discrete panels along lines of weakness to thereby provide an accordion folded multi-panel set of panels, together with (a) an aligned hole in the set of accordion folded panels to thereby enable the set to be suspended from prong means and (b) a single staple or other securement means which maintains the set in a structurally self-supporting condition for shipment and display.

20 Claims, 1 Drawing Sheet

FOLDING LABEL PACKAGE

This invention relates generally to labels and specifically to labels formed in a package which is economical to produce, ship, display and use, and which requires only a minimum of display space in a retail outlet.

BACKGROUND OF THE INVENTION

Sheeted labels are conventionally sold in retail outlets in one of two forms.

In a first form a plurality of individual sheets, with each sheet carrying one or more labels, are collected and sold as a group of individual sheets in a clear flexible container such as a clear poly bag. Very frequently the bag includes a header card to which the poly bag is stapled and from which the poly bag depends. The header card serves the multiple functions of (a) forming a closure for the poly bag containing the sheets of labels, (b) a display space to identify and advertise the product and disclose its cost, and (c) a means for suspending the bagged products from a display member, such as a prong or hook which projects outwardly from a peg board or other support structure.

In a second form a plurality of individual sheets, with each sheet carrying one or more labels, are formed into a stack and placed on a backer card, the backer card almost invariably being heavier and thicker than the label sheets. The stack of label sheets is then shrink wrapped to the backer card to form a unitary package. The backer card invariably projects upwardly beyond the top of the stacked label sheets to, again, function as (a) a part of the closure, or position maintenance, of the individual label sheets, (b) a display space to identify and advertise the product and disclose its cost, and (c) a means for suspending the shrink wrapped products from a display member, such as a hook, or alternatively, stacking the individual packages in an upright, generally vertical position if the packages are to be displayed on a flat surface such as a shelf Although both forms of packaging have been widely used, each has certain drawbacks which prevent the system from being considered the ideal, or near ideal, display system.

In the first, or poly bag, form a vertical display space which is considerably higher than the height of the label sheets is required due to the vertical height of the header card and the additional space required to gather the front and back sides of the poly bag preparatory to bringing them together in a flat condition prior to being stapled or otherwise secured to the bottom of the header card. Further, the header card system requires two components in addition to the collected and stacked label sheets, namely the header card and the poly bag. On top of the raw cost of the two additional system components there is an additional cost of assembly and shipping, since the header card requires assembly time and space additional to the space of the group of collected label sheets. Further, the attachment of a poly bag package to a support structure, such as a prong or hook extending outwardly from a peg board, is more difficult and cumbersome by a human operator due to the floppiness of the unit. And once assembled, the poly bag, no matter how clearly transparent it may be, compromises the appearance of the contained product to some extent, and possibly to a significant extent, if the poly bag material only loosely contains the label sheets; folds and creases may be present which tend to distort the appearance of the contents and/or create a lack of definition of indicia on the product resulting from the use of bagging material which is not fully transparent. Indeed, cloudy bagging material may transmit a utilitarian or low quality appearance to the eye of the potential purchaser.

In the second, or shrink wrap, form a vertical display space which is considerably higher than the height of the label sheets is required due to the projection of the top of the backer card above the top of the collected label sheets since the backer card must provide a free, flat surface to which the shrink wrap can be adhered. Further, the shrink wrap system requires two components in addition to the collected and stacked label sheets, namely the backer card and the shrink wrap. On top of the raw cost of the two additional system components there is an additional cost of assembly and shipping, since the backer card requires assembly time and space in addition to the space of the group of collected cards; indeed the additional space requirements are usually greater than the additional space required in the poly bag system, which is usually floppy in final structure, due to the rigidity of the backer card. The thick backer card, together with the enclosing layer of shrink wrap material also requires more space in a stacked direction. Once assembled, the shrink wrap material may compromise the appearance of the contained product to some extent due to lack of definition of indicia on the product resulting from use of shrink wrap material which is not fully transparent.

It will also be appreciated that in both of the above described forms of the conventional product the manufacture of the label sheets is compromised in that the individual label sheets must be manufactured separately from pre-cut, individual pieces of stock, or, if manufactured in a continuous system, each label sheet requires a separate cutting operation—which obviously compromises high speed production.

Accordingly, there is a need for a label system, and packages of labels, in which the labels may be manufactured in a near continuous process, no supplementary packaging components are required, shipping space is needed only for the labels themselves (i.e.: no extraneous space for packaging/display components) and the final impression to the eye of a potential purchaser is maximized by the absence of any material extraneous to the labels.

SUMMARY OF THE INVENTION

The invention is a set of label sheets in which any desired number of label sheets may be manufactured in a continuous process with only one cutting operation per set of label sheets, said label sheets being accordion folded and securable to one another by any common securement means, such as a staple, said set not requiring any space beyond the dimensions of the set of label sheets. Further, no additional packaging components are required since the inherent rigidity of the set of label sheets provides all the structural integrity needed to handle, ship, assemble and display the set of label sheets as a package right up to the moment of purchase in a retail outlet. And further, in use, the label sheets remain together in a rigid bulk form so that they do not scatter and/or tend to become dog-eared or torn prior to use.

BRIEF DESCRIPTION OF THE DRAWING

The is invention illustrated, more or less dramatically, in the accompanying drawing in which.

DETAILED DESCRIPTION OF THE INVENTION

Figures 1, 2, 3, 4:
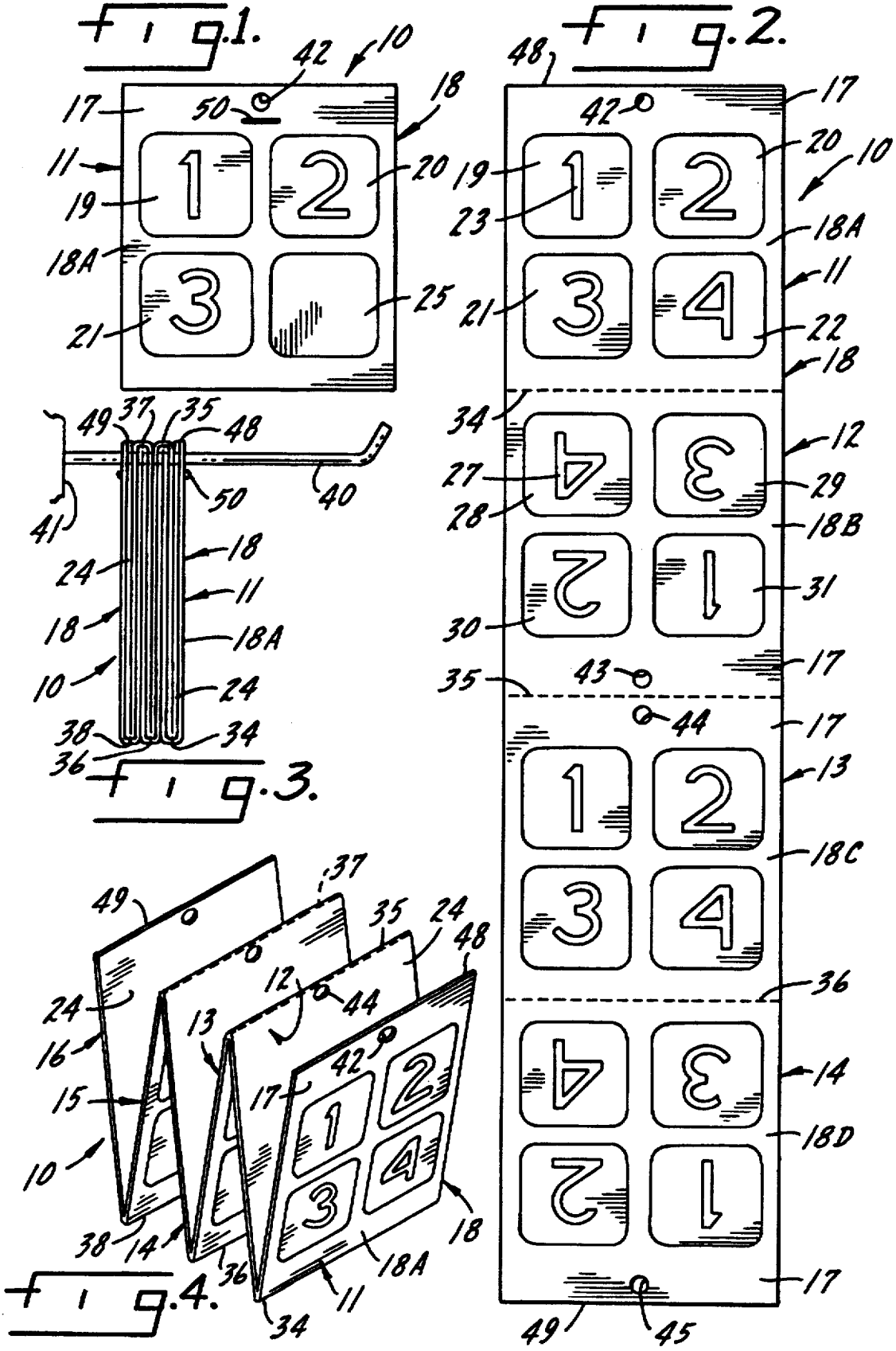
FIG. 1 is a front view of a set of label sheets of this invention which has been formed into a package of label sheets.
FIG. 2 is a top plan view of a set of connected label sheets or panels in their just manufactured condition prior to folding.
FIG. 3 is a left side view of a set of label sheets displayed for sale in a retail outlet illustrating particularly the multi-ply structure of the sheets.
FIG. 4 is a perspective view of a connected series or set of panels which illustrates the accordion folding of the panels.

In the following description of the invention like reference numerals will be used to refer to like or similar parts from Figure to Figure in the drawing.

The package or set of labels of this invention is indicated generally at 10 in FIG. 1. The set is shown in its as-manufactured condition and is complete except for one label which has been removed from the first or top panel in the package by a user. The set 10 consists of any desired number of panels of labels, four panels being shown in FIG. 2 and six panels being shown in FIGS. 3 and 4. Panel 11 is shown in FIG. 1 and, in addition, in all other Figures. Panels 12–14 appear in FIGS. 2 and 3 and, in addition, panels 15 and 16 appear in FIGS. 3 and 4. Since each panel is identical to every other panel, except for the relation of the indicia to the physical elements and location of the suspending means, only panel 11 need be described in detail.

Panel 11 consists of two plys of material. The top ply, which is usually referred to as label stock, is indicated generally at 18. The label stock can be composed of foil, such as aluminum foil or metallized paper, or be a plastic film formed from vinyl, Mylar or one of the olefins. Paper is also an acceptable material, and it is currently widely used in the industry. Though the thickness of the label stock may vary widely, it is preferred that the thickness be in the range of on the order of from about 0.004 to about 0.0045 inches. As can be best appreciated from FIG. 2, the label stock is preferably in roll form to facilitate continuous manufacture. It will be understood that the label stock 18 is sub-divided into panel sections indicated at 18A, 18B, 18C and 18D in FIG. 2.

A plurality of individual labels, here four, are die cut into label stock 18, said labels being shown at 19, 20, 21 and 22. Each label has a continuous cut periphery so that it may be peeled away from the balance of the panel by finger applied pressure of a user since the cut which outlines each label passes completely through label stock 18. Indicia on each label is indicated at 23. Preferably an advertising space is provided at the top of each panel as indicated at 17.

The bottom ply of panel 11, which is usually referred to as the liner or backing paper, is indicated at 24, see FIGS. 3 and 4, and is preferably formed from paper. Although the thickness of the paper may vary widely, it is believed that a suitable thickness is on the order of about 0.003 inches so that the thickness of the multi-ply structure is preferably on the order of from about 0.007 to about 0.0075 inches. A suitable material, such as a silicone coating, is present on the upper surface of backing paper 24 to facilitate easy separation of individual labels in label stock 18 from backing paper 24. From FIG. 1 it will be noted that label 22 has been removed from panel section 18A, thus exposing a portion, 25, of the liner 24, said portion being an area bounded by the cut line in panel section 18A of ply 18 which defined label 22. The label stock and bottom ply are maintained in abutting, bonded relationship by a conventional layer of pressure sensitive adhesive or a static cling bond, not shown.

Referring to FIG. 2 it will be seen that the indicia 27 on each of labels 28–31 in panel section 18B of label stock 18 is inverted, in a reading context, as contrasted to the orientation of the indicia 23 in panel section 18A. Fold means 34, 35, 36 between the panel sections 18A–18D, and their associated portions of the backing paper 24, define the four panels 11–14 of FIG. 2. The fold means are preferably perforations which extend through both label stock 18 and liner 24 to form a line of weakness between adjacent panel sections to facilitate folding along said lines of weakness. Additional lines of weakness are indicated at 37 and 38 in FIGS. 3 and 4 since there are six panel sections in the panel set of FIGS. 3 and 4 as contrasted to four panel sections in FIG. 2.

Means for supporting a package or set of panels from a support structure, such as a prong 40 which extends outwardly from a peg board or other base structure 41, are formed in each panel. In this instance the supporting means are holes 42, 43, 44 and 45 in the four panels of FIG. 2. As can be best seen in FIG. 2, the hole in each panel is formed in alternate edges of the panel so that when a set of panels is accordion folded, as seen in FIGS. 3 and 4, the holes in each panel will be in alignment. The extreme ends 48 and 49 of a set of panels are formed by cutting completely through the label stock 18 and the backing paper 24.

A compact, structurally self-supporting structure is formed by applying securement means to hold all panels in a set of panels together. Here a single staple, indicated at 50 which passes through each panel in the set of panels, holds the six panels of the six panel sets of FIGS. 3 and 4 together as a group.

In operation, aligned rolls of label stock 18 and release coated backing paper 24 are pressed together, in conjunction with the described bonding means, to form a two ply structure, the individual labels are die cut in the label stock and the perforations 34–36 are made in the two ply structure, the indicia is printed on the label stock (if it has not been pre-printed), and thereafter the ends 48 and 49 are formed by cutting means. After folding along the lines of weakness 34–36 each panel set is stapled as at 50 and thereafter packed, by stacking as many as desired, in a shipper container. Upon reaching a retail outlet, a clerk grasps as many sets as can be conveniently handled and threads them on to prong 40 or other supporting structure. The panel sets will automatically align with one another thereby presenting a neat and pleasing appearance to the eye of a potential purchaser. The header space 17 can be as wide or narrow as desired, or can even be eliminated altogether if shelf labels are used. The result is speedily manufactured, neat, self-supporting sets of labels which require a minimum of structural components and no separate packaging components for shipment and display at a retail outlet.

Although a specific example, and modifications thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by a foregoing exemplary description.

What is claimed is:

1. A label package, said label package consisting of a plurality of label panels, each label panel consisting of label stock releasably secured to a liner, a label formed in the label stock, said label being removable by hand from the balance of the label stock and the liner, successive panels being accordion folded against one another to thereby form a set of panels whose peripheral dimensions are no greater than the peripheral dimensions of a single panel, means formed in each panel for supporting the plurality of label panels from a support location, and means for securing the label panels to each other to form a structurally self-supporting shipping and display package in the absence of additional packaging components for shipping and display, the means for securing the label panels to each other to form a structurally self-supporting shipping and display package comprising a fastener passing through aligned portions of the label stock of each panel which does not contain a label.

2. The label package of claim 1 further characterized in that a plurality of labels are formed in the label stock of each panel.

3. The label package of claim 1 further characterized by and including a line of weakness formed between successive panels to thereby provide a fold line between each pair of successive panels in a set of panels.

4. The label package of claim 3 further characterized in that the line of weakness is formed by perforations.

5. The label package of claim 1 further including indicia printed on the label or labels in each successive pair of panels.

6. The label package of claim 5 further characterized in that the indicia printed on the labels in each successive pair of panels are inverted, one panel to the next, whereby, when the successive panels are accordion folded, the indicia in all panels are oriented in the same direction.

7. The label package of claim 6 further characterized in that the means formed in each label panel for supporting the label panels from a support location are holes in said label panels which are in alignment when the set of label panels is accordion folded.

8. The label package of claim 7 further characterized in that each panel contains only a single hole.

9. The label package of claim 8 further characterized in that the hole in each label panel is located near one edge thereof.

10. The label package of claim 1 further characterized in that the label stock of each panel includes an area, outside the labels in said label stock, of a size sufficient to receive advertising and pricing information pertaining to the label package.

11. The label package of claim 10 further characterized in that the advertising and pricing information areas on the label stock of successive panels are aligned with one another.

12. A label package consisting of a plurality of label panels, each label panel consisting of label stock releasably secured to a liner, at least one label formed in the label stock, each label being removable by hand from the balance of the label stock and the liner, successive panels being accordion folded against one another to thereby form a set of panels whose peripheral dimensions are no greater than the peripheral dimensions of a single panel, means formed in each panel for supporting the plurality of label panels from a support location, and means for securing the label panels to each other to form a structurally self-supporting shipping and display package in the absence of additional packaging components for shipping and display, wherein indicia are printed on each label in each successive pair of panels and the indicia printed on each label in each successive pair of panels are inverted, one panel to the next, whereby, when the successive panels are accordion folded, the indica in all panels are oriented in the same direction.

13. The label package of claim 12 further characterized in that a plurality of labels are formed in the label stock of each panel.

14. The label package of claim 12 further characterized by and including a line of weakness formed between successive panels to thereby provide a fold line between each pair of successive panels in a set of panels.

15. The label package of claim 14 further characterized in that the line of weakness is formed by perforations.

16. The label package of claim 12 further characterized in that the means formed in each label panel for supporting the label panels from a support location are holes in said label panels which are in alignment when the set of label panels is accordion folded.

17. The label package of claim 16 further characterized in that each panel contains only a single hole and the hole in each label panel is located near one edge thereof.

18. The label package of claim 12 further characterized in that the means for securing the label panels to each other to form structurally self-supporting shipping and display packages is a fastener passing through aligned portions of the label stock of each panel which does not contain a label.

19. The label package of claim 12 further characterized in that the label stock of each panel includes an area, outside the labels in said label stock, of a size sufficient to receive advertising and pricing information pertaining to the label package.

20. The label package of claim 19 further characterized in that the advertising and pricing information areas on the label stock of successive panels are aligned with one another.

* * * * *